US006817951B2

(12) United States Patent
Levine

(10) Patent No.: US 6,817,951 B2
(45) Date of Patent: Nov. 16, 2004

(54) NOVELTY ITEM

(76) Inventor: Steven Levine, 7 Plymouth Dr., Scarsdale, NY (US) 10583

( * ) Notice: Subject to any disclaimer, the term of this patent is extended or adjusted under 35 U.S.C. 154(b) by 352 days.

(21) Appl. No.: 10/054,686

(22) Filed: Nov. 13, 2001

(65) Prior Publication Data

US 2003/0232657 A1 Dec. 18, 2003

(51) Int. Cl.[7] ..... A63J 5/02

(52) U.S. Cl. ..... 472/57; 472/65; 426/477; 206/217

(58) Field of Search ..... 472/57, 65, 51, 472/52, 137; 426/86, 112, 115, 477, 591; 446/153, 267; 206/217, 221, 568

(56) References Cited

U.S. PATENT DOCUMENTS 3,071,888 A * 1/1963 Knott ..... 446/267
4,147,808 A * 4/1979 Liepa et al. ..... 426/477
4,170,320 A * 10/1979 Eagar ..... 222/146.6
4,316,409 A * 2/1982 Adams et al. ..... 99/275
6,199,386 B1 * 3/2001 Garrett et al. ..... 62/51.1

* cited by examiner

*Primary Examiner*—Kien Nguyen
(74) *Attorney, Agent, or Firm*—Bodner & O'Rourke; Thomas A. O'Rourke

(57) ABSTRACT

An improved novelty item is disclosed. The novelty item has a container that receives a solid piece of carbon dioxide when the solid carbon dioxide contacts water vapor in the container a fog is created. As the solid carbon dioxide sublimates, the water vapor is emitted from the container as a visible fog. The container may be in the shape of any number of designs for which the visible fog streaming from the container creates a pleasing illusion.

14 Claims, 5 Drawing Sheets

NOVELTY ITEM

FIELD OF THE INVENTION

The present invention relates to a unique novelty item for vending beverages and the like.

BACKGROUND OF THE INVENTION

Entertainment is a major industry today. Each year countless people visit amusement parks, theaters, sporting events etc. As part of the visit many people purchase souvenir items to bring home as a memento of the trip. These souvenirs can vary in cost from a relatively nominal amount to very expensive. If there is one characteristic that defines the types of souvenir items that are available it is diversity. There is usual no uniform attribute that can describe these products. In fact the breadth of items offered at many tourist attractions can rival the offerings of a major department store. There, items available can range from the ubiquitous stuffed animals, clothing, dinnerware and others. Even at sporting events there are a broad variety of these products competing for the patron's dollars as well.

Although there is a great diversity of products available to the tourist there is very little new that can catch the tourist's eye. Almost every gift shop has the standard fare of signature items and there are very few items available that are truly unique. In many instances the sole difference between the different locales is merely the name of the attraction the item.

Besides the traditional souvenirs, many establishments have transformed more mundane items into a souvenir opportunity. For example, food and beverage sales are an important revenue stream at many entertainment events. Beverages sales can amount to significant sums at popular attractions. Recently, beverages have become a combination food product and souvenir at many locations as the beverages have begun to be offered in special souvenir containers. At ballparks for example, the beverages frequently are sold in plastic cups bearing the team logo, mascot, one or more players pictures and perhaps even scenes from earlier seasons. A higher price is charged for these containers with the idea that the fan can bring the cup home as a remembrance of the day. Other activities have similar product offerings.

Although not everyone is necessarily interested in a souvenir of their trip, there is one group of consumers that is almost always interested in them. This group is children, particularly younger children that have a tendency to place several requests for souvenirs at virtually any event or activity. While many parents and other relatives are reluctant to purchase these products they frequently relent in the face of determination from the younger set.

In view of the importance of these items as a revenue stream for many of these properties, the proprietors of these venues seek new and different items to be added to their product line. Many purchasers become adverse to purchasing souvenirs when the product line offers nothing different from other establishments. As a result, there is a need for new and unique novelty items to be offered to customers of various activities. In addition to being unique, these items are preferably distinctive and eye catching to the consumer.

OBJECTS OF THE INVENTION

It is an object of the invention to provide a unique novelty item for use at various attractions.

It is also an object of the invention to provide an improved visually distinctive novelty item.

It is a further object of the invention to provide a novelty item that creates a unique experience for the purchaser of the product.

It is also an object of the invention to provide an improved novelty item that may be tied into the theme of one or more characters, locales, themes etc. of a tourist attraction.

It is still another object of the invention to provide a novelty item that can be used at parties and other recreation activities to increase the enjoyment of the user.

SUMMARY OF THE INVENTION

The present invention is directed to a unique novelty item for use in connection with beverages and other liquid or semi liquid products. This novelty item makes use of solid carbon dioxide which is colloquially called dry ice. The dry ice is placed in a container where it contacts a liquid or semi liquid material. Because the solid carbon dioxide is at a very low temperature, the cold provided by the solid carbon dioxide causes any water vapor present in the container to fall in temperature so that it turns into a visible cloud of water vapor that is propelled from the container by the sublimation of the solid carbon dioxide into gaseous carbon dioxide. The release of the water vapor from the container creates a visual effect that is similar to smoke without the deleterious by products of smoke. The container for the solid carbon dioxide is preferably in the shape of a character, animal, vehicle and other attractive and interesting subject. The selection of the type of container that may be used for the novelty item can create unique special effects. For example, if the container is in the shape of a dragon, providing an opening at the mouth of the dragon for the water vapor to be released give the impression that the dragon is a fire breathing dragon because of the water vapor being expelled from the dragon's mouth. Another example, for the container is a train. In this example, if the train is provided with a opening at the smokestack, the impression is created that the engine is operating and releasing smoke. Another item may be a rocket or other space exploration vehicle. Virtually any other shapes are possible for the container of the novelty item.

The novelty item of the present invention is a container or other vessel having a reservoir or interior portion for receiving a fluid or semi liquid. A removable cap or screw on with locking feature is provided to retain the fluid or semi liquid in the receptacle. The interior of the container or receptacle has a first reservoir area and a second reservoir area. The first and second areas are separated by separation means. The separation means may be a grate a mesh a plate etc., provided that it has certain attributes. First, the separation means is preferably securable to the region of the container separating the two sections. This secures the solid carbon dioxide and prevents it from being released from the first reservoir before it has sublimated into a gas. This separation means is necessary where a beverage is present in the container or if it will be added subsequently. The separation means prevents the solid carbon dioxide from coming into contact with the user while it is still a solid. Solid carbon dioxide is typically at a temperature of −78.5° C., or −109.3° F. If the solid carbon dioxide comes into contact with a person there is a risk of skin damage due to the extremely cold temperature.

The separation means may be permanently secured to the container usually at its interior wall or removably secured thereto. If it is permanently secured thereto there must be a means for providing access to the first reservoir section for cleaning and for the addition of the solid carbon dioxide. A door or removable section could accomplish this. A grate or mesh has been found to be particularly useful as a separation means. The openings in the grate or mesh provide a means for the gaseous carbon dioxide to escape from the first reservoir as well as permitting a liquid to flow into the first reservoir. The separation means is preferably removably secured in place so that it does not become dislodged while solid carbon dioxide is present in the reservoir. In one embodiment, the separation means is hingedly attached to the container so that it may be raised for insertion of the solid carbon dioxide and for ease of cleaning.

BRIEF DESCRIPTION OF THE DRAWINGS

FIG. 1 is an example of a separation means for retaining the solid carbon dioxide in position.

DETAILED DESCRIPTION OF THE INVENTION

Figure 1:
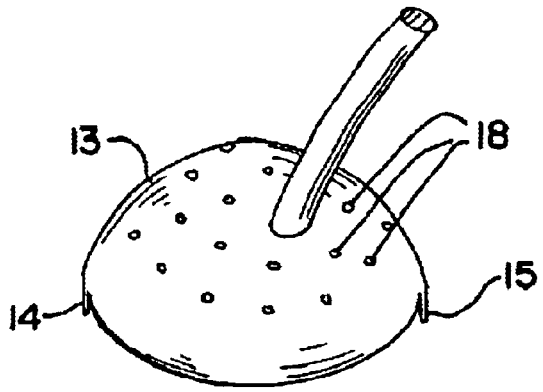
FIG. 1 is a representation of an example of a novelty item of the present invention.
Figure 13:
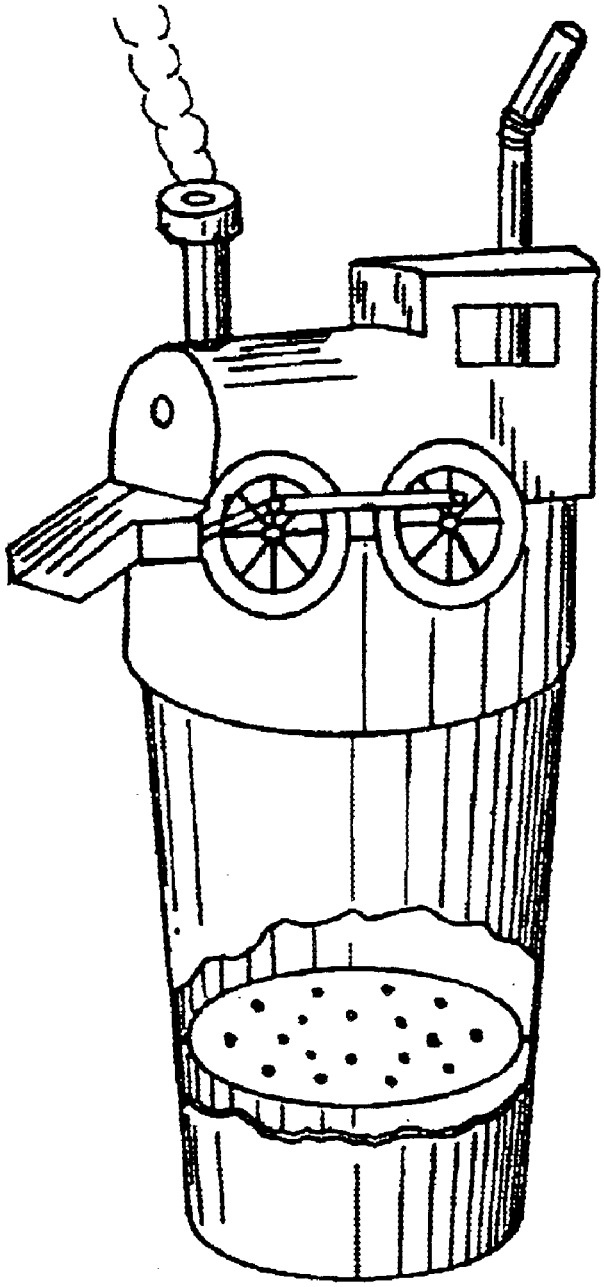
FIG. 13 shows another example of a novelty item of the present invention.

As seen in FIG. 1 there is a receptacle or vessel 10 that is intended to hold a beverage or other liquid or semi liquid as well as a quantity of solid carbon dioxide. As used herein the term beverage can include any liquid or semi liquid material that is desired from water, juice, carbonated beverages, ice cream, custard, coffee and even other liquid or semi-liquids that are not potable. The container 10 may be any shape or size. Preferably, the container is in the form of a character or other design such as a train, rocket etc. See FIG. 13. The type of designs for the container is limitless.

Carbon dioxide is nonflammable, colorless, and odorless in the gaseous and liquid states. The gas is approximately one and one-half times as heavy as air. Carbon dioxide is a minor but important constituent of the atmosphere, averaging about 0.03% or 300 ppm by volume. Dry ice is frozen carbon dioxide, or $CO_2$, which is a gas under standard temperature and pressure conditions. The atmosphere contains about 0.035% of this gas. At normal atmospheric pressure frozen $CO_2$ doesn't melt into a liquid, but rather evaporates directly into its gaseous form. This process is called sublimation.

One way to make solid carbon dioxide is to cool carbon dioxide gas at high pressure (up to 70 atm.) and liquefies in consequence. Further cooling takes the carbon dioxide to the triple point, where all the three states—gaseous, liquid, solid—can co-exist simultaneously. For CO2 this point is located at 5.1 atm. and −56.2 degree C. Now the compressed liquid carbon dioxide is suddenly expanded by spraying and turns into ""snow"". This happens because the evaporation of part of the liquid causes intensive cooling of the rest. The dividing line between liquid and solid in is crossed: the carbon dioxide turns from liquid to solid. To achieve this result, the carbon dioxide gas is liquefied by means of three or four stage compressors with intermediate and final cooling, the liquid carbon dioxide then being expanded in a tower. About one-third of the liquid is thereby transformed into snow; the other two-thirds turn into gas, which is removed by suction, recompressed, and returned to the process. The snow is pressed into blocks weighing 50–250 lb.

Due to its extremely cold temperature (−78.5° C., or −109.3° F.), dry ice can cause damage to the skin if handled. When you place dry ice into some warm or hot water, clouds of white fog are created. This white fog is not the $CO_2$ gas, but rather it is condensed water vapor, mixed in with the invisible $CO_2$. Dry ice, being frozen $CO_2$ gas, can be used to carbonate water to create sparkling water.

The container 10 has an interior 11 and an exterior 12. The interior acts as a reservoir for the beverage. There should be a means for obtaining access to the interior of the container 12. This may be by means of a cap 13 or by separating two portions of the container. The cap or the two portions of the container may be threaded so that they may be secured in position. Other means of securing are also possible such as a snap fit or a friction fit. FIG. 1 shows the use of locking tabs 14 and 15 the mate with members 16 and 17. The locking tabs may be provided with, for example, an orifice (not shown) that receives a member 16 or 17. In order to remove the cap a tab is lifted to remove the member thus permitting the cap to be lifted off. The cap is preferably secured to the remainder of the container by a strap, string or other appropriate means so that the cap and body of the container do not become separated from each other and lost.

The container is intended to hold a quantity of solid carbon dioxide that will revert to the gaseous state as its temperature rises. The pressure in the container is likely to significantly increase as the sublimation occurs. Consequently the container should provide a means for the carbon dioxide gas to escape. Thus, there should be one or more orifices 18 to provide a release for the carbon dioxide gas. Also, the seal between the cap and the container or the seal between the two or more portions of the container should not be airtight and permit carbon dioxide gas to escape. Straws 19 may also be used to exhaust carbon dioxide gas from the vessel. The visual image of the water vapor exiting the straw can add to the desirability of the novelty item of the present invention.

The design of the holes or orifices for the release of carbon dioxide also can enhance the novelty feature of the present invention. For example, the placement of the orifice in a steam locomotive design at the smokestack creates the impression the train is ready to move. See FIG. 13. Similarly, the placement at the underside of a rocket gives the impression that the rocket engines are operating. It will be appreciated by those skilled in the art that the variety of possible designs for the container where the exhaust of water vapor creates the impression of smoke or other vapor being released is unlimited.

In operation a piece of solid carbon dioxide is placed in the container. A liquid, preferably a water based liquid, is placed in the container either before or after the placement of the solid carbon dioxide when the solid carbon dioxide cools the liquid any water vapor present forms a fog in the container. This fog is expelled from the container by the pressure of the carbon dioxide gas formed from the sublimation of the solid carbon dioxide. Since the volume of a gas is significantly greater than the volume of a solid, the volume of carbon dioxide gas and water vapor in the container causes an increase in the pressure in the container. This increase in pressure in turn causes the gas in the container to seek a region where there is less pressure. This region is the outside of the container. As a result, the carbon dioxide gas and water vapor are released by the container through any orifices that are present in the container. If the increased pressure is not released then there is a risk that the container could explode. Consequently, for safety reasons, it is preferred that the orifices be of such size that the pressure will not increase in the container to dangerous levels. The escape of the gases from the container can also add to the enjoyment of the produce. The hissing sound of the gas could correlate to the particular character. Also the escaping gas could also operate a whistle for a boat or train or other design.

Figure 2:
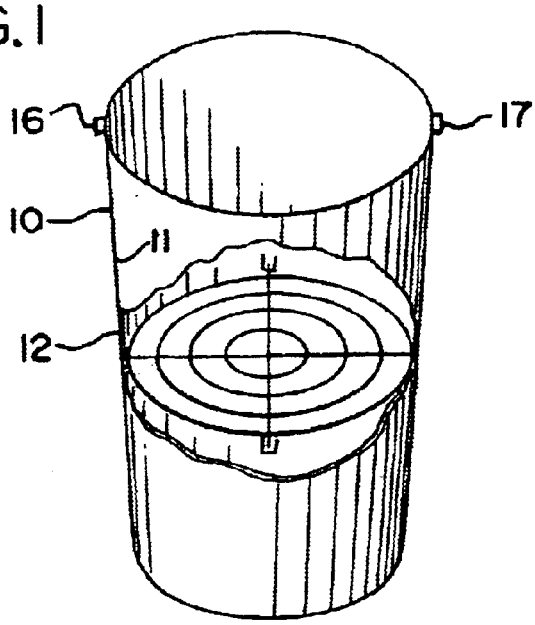
FIG. 2 is an alternative embodiment of the separation means of FIG. 1A.
Figure 2:
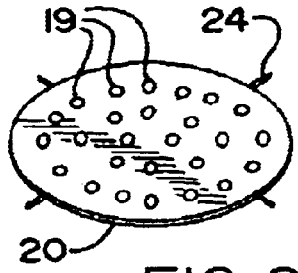
Figure 3:
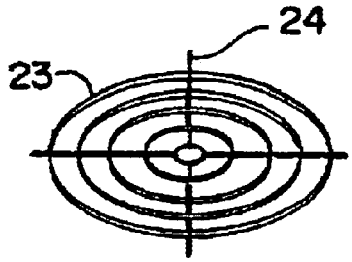
FIG. 3 is a partial view of the interior sidewall of the novelty item showing a means for retaining the separation means in position.
Figure 4:
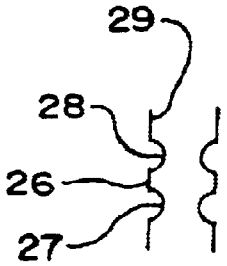
FIG. 4 is a view of an alternative embodiment of the positioning of the separation means.
Figure 5:
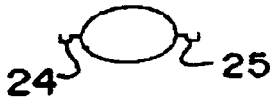
FIG. 5 is an alternative embodiment of the novelty item of FIG. 1.
Figure 6:
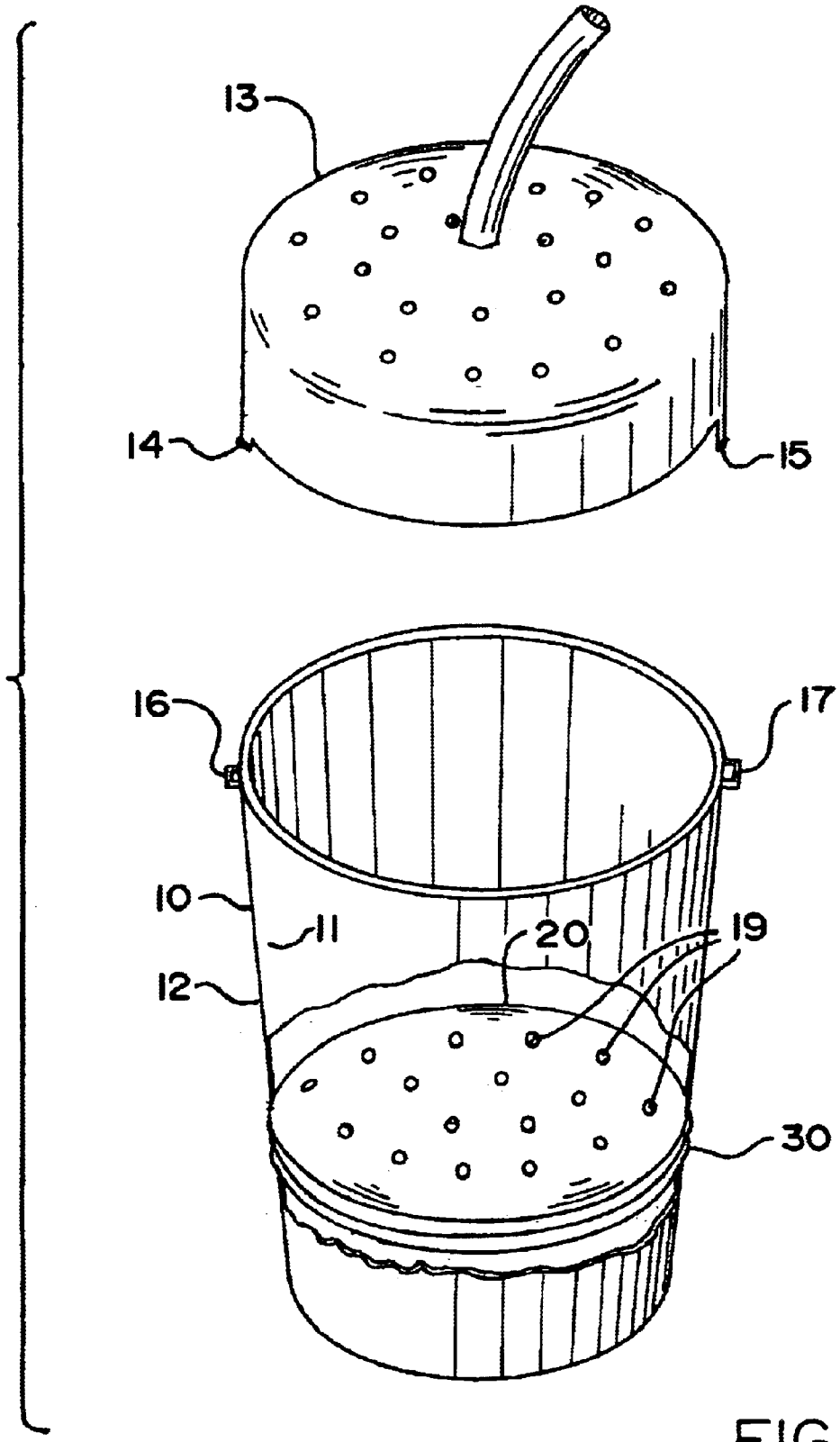
FIG. 6 is another embodiment of the novelty item of the present invention.

Because of the low temperature of the solid carbon dioxide it is preferred that the container afford protection to the user to prevent the user's skin or other tissue from coming into contact with the dry ice. One approach to this is to include a grill or mesh (See FIG. 3) or other separation means in the container to retain or restrain the solid carbon dioxide. The separation means preferably has orifices for the release of the carbon dioxide gas but these orifices are small enough to prevent all but the smallest pieces of solid carbon dioxide from passing through the separation means. As seen in FIG. 2 the separation means may have a plurality of orifices 19 on a disk 20. Alternatively, there may be a grill 23 that retains the dry ice. FIGS. 2 and 3 show the disk and the grill with four prongs 24 that may be used to secure the separation means to the container. These prongs can, for example, rest in recesses in the sidewall of the container or in a generally U-shaped receiving member 25 on the sidewall of the container. Alternatively, the separation means, usually without the prongs can be secured by inserting the separation means between in a recess 26 formed by a first protruding member 27 and a second protruding member 28 that extend from the sidewall 29 of the container. While this retaining means may be on only opposite sides of the container side wall, it will be appreciated that they can extend over a greater proportion of the interior circumference of the sidewall including its entirely. The separation means is preferably removable to facilitate loading the container with solid carbon dioxide. Another embodiment of the retaining means is shown in FIG. 6. In this example, the separation means may have a threaded edge that can screw into a threaded member on the sidewall of the container. The male thread may be on the separation means and the female thread 30 on the sidewall in one embodiment. The reverse may be used in another embodiment. Alternatively, the separation means can be merely wedged into position on the interior of the container. For example, the Figures show a tapered container. The separation means can be inserted into the container until the reduced cross sectional area of the container causes the separation means to contact the sidewall and be retained in position. This can be facilitated by the use of, for example a rubber or other type gasket that will firmly retain the separation means in position. It will be appreciated that although the separation means has been shown generally circular there are no limitations on the shape of the container or the shape of the separating means.

Figure 7:
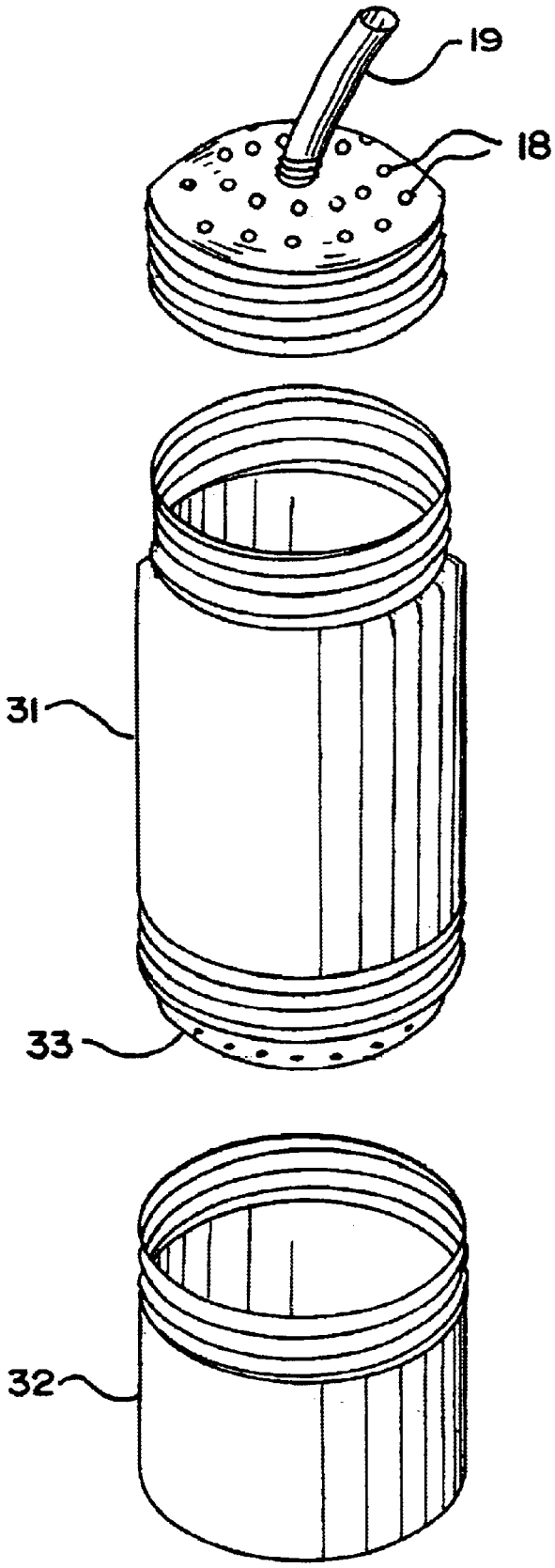
FIG. 7 is another example of a novelty item of the present invention.

In another embodiment, the container may be in two or more sections 31 and 32 that can be joined together to form the container. The separation means 33 may be on one of the container portions or the other as desired. As seen in FIG. 7 the solid carbon dioxide can be placed in base section 32. The separation means 33 may be unitary with the top section 31 or removably connected and the top section is placed over a second container portion 32. The two sections may be joined by any suitable means such as a threaded connection, a bayonet fitting, a snap fit, a friction fit etc. FIG. 7 shows a threaded connection.

Figure 9:
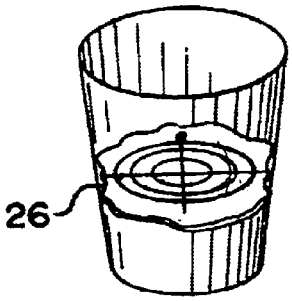
FIG. 9 shows an alternative separation means that may be used with the present invention.
Figure 12:
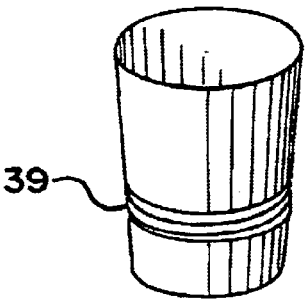
FIG. 12 shows an alternative means for retaining the separation means in position.

In another embodiment of the invention, the separation means may be in the form of a disk with linear openings in the surface as seen in FIG. 9 that extends across a portion of the container. The disk may also be in the form of a flexible membrane, a grate or a mesh. The flexible membrane may made of any suitable material and this material can be mounted on a frame. The membrane may have orifices, slits, a flap or other means for retaining solid carbon dioxide but releasing gaseous carbon dioxide. Alternatively, the separation means may be one or more rods or shafts that extend from one side of the container to the other and which are positioned such that they are close enough together so that larger pieces of solid carbon dioxide are incapable of passing to the other portion of the container. The separation means is preferably removable or at least tiltable to permit the larger initial piece of solid carbon dioxide to be placed into the container. See FIG. 9, which shows a separation means rotating about the retaining means 26 to permit the insertion of solid carbon dioxide. The separation means may be secured in position by any suitable means. One preferred means is to provide the inner wall of the container with a recess portion that receives the separation means and retains it in position. In another embodiment, the separation means may be hingedly connected to one side of the container wall with a retaining means on another wall. The retaining means can releasably retain the separation means in position when desired and release the separation means when it is necessary to add more solid carbon dioxide. FIG. 12 shows the interior wall of the container with threads 39 that permit the separation means to be threaded into position.

Figure 8:
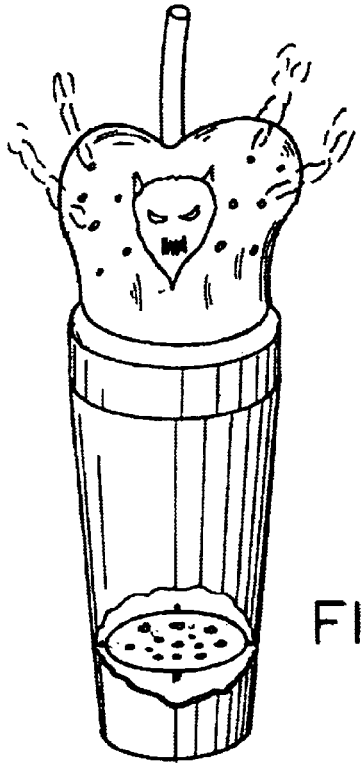
FIG. 8 is another example of a novelty item of the present invention.
Figure 10:
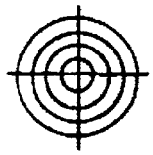
FIG. 10 shows an alternative separation means that may be used with the present invention.
Figure 11:
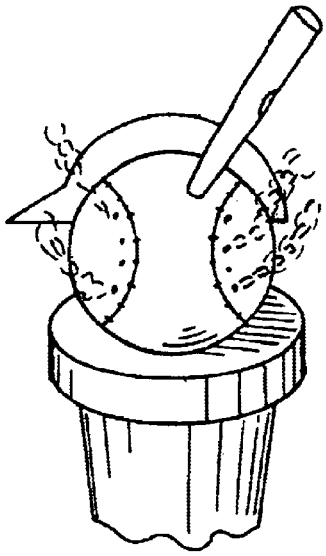
FIG. 11 is another example of a novelty item of the present invention.

FIGS. 8 and 11 show, inter alia, various venting approaches to the release of water vapor or carbon dioxide In FIG. 8 the design on the container is such that the water vapor exits the face and enhances the image created. Similarly, in FIG. 11 the water vapor exits through the baseball seams creating the impression of a extremely high velocity pitch.

The beverage may be dispensed by a straw or by removing the cap. In one mode of operation a vendor or other person positions one or more pieces of solid carbon dioxide in a first portion of the container. The separation means may be positioned at that time or later after the beverage is dispensed into the container. As the vendor or other person adds the beverage to the container the beverage contacts the solid dry ice. Because the solid dry is so cold the beverage is cooled. Any water vapor that is present in the beverage turns into a fog in the container that is expelled from the container by the carbon dioxide gas formed by the sublimation of the solid carbon dioxide. The water vapor fog creates the impression of smoke or other material emanating from the container.

Another feature of the present invention is that the solid carbon dioxide adds additional carbonation to any beverage that is contained in the container.

I claim:

1. An improved novelty item comprising a container having an opening therein, said container having a first material present and solid carbon dioxide and wherein the first material present therein has an initial temperature in the container higher than the solid carbon dioxide forms a fog as said solid carbon dioxide contacts said first material in the container said container having at least one orifice for releasing the fog from the container said fog being visible as it is emitted from the container and wherein the container has a first portion and a second portion and wherein the first and second portions are separated by a separation means that prevents pieces of solid carbon dioxide from passing from said first portion to said second portion but permits carbon dioxide gas formed from the sublimation of the solid carbon dioxide to pass through.

2. The novelty item according to claim 1 wherein the separation means is a mesh.

3. The novelty item according to claim 1 wherein the separation means is a grate.

4. The novelty item according to claim 1 wherein the container is in the shape of a character.

5. The novelty item according to claim 1 wherein the container is in the form of a vehicle.

6. The novelty item according to claim 1 wherein the fog so created contains water vapor.

7. The novelty item according to claim 1 wherein a gas in the container is emitted it generates sound.

8. The novelty item according to claim 1 wherein a gas in the container is emitted it generates bubbles.

9. The novelty item according to claim 1 wherein the first material is a beverage.

10. The novelty item according to claim 1 wherein the container is in the shape of an animal.

11. An improved novelty item comprising a container having an interior and an exterior surface, said interior surface having removably connected to at least a portion thereof a separation means, said separation means forming with said interior surface a first chamber and a second chamber, one of said chambers being formed by a portion of the interior surface and the separation means and the second of said chambers being formed by a second portion of the interior surface and said separation means, one of said chambers having solid carbon dioxide and a second material therein, said second material producing water vapor in the container, said second material having an initial temperature higher than the solid carbon dioxide, said container having at least one orifice for releasing the water vapor in the form of a visible fog from the container as the solid carbon dioxide sublimates said separation means prevents pieces of solid carbon dioxide from passing from said first chamber to said second chamber but permits carbon dioxide gas formed from the sublimation of the solid carbon dioxide to pass through.

12. An improved novelty item comprising a container having an interior and an exterior surface, said interior surface having removably connected to at least a portion thereof a separation means said separation means forming with said interior surface a first chamber and a second chamber, one of said chambers having solid carbon dioxide and a second material therein, said second material having an initial temperature higher than the solid carbon dioxide, said container having at least one orifice for releasing a vapor in the form of a visible fog from the container as the solid carbon dioxide sublimates, and wherein said separation means prevents pieces of solid carbon dioxide from passing from said first chamber to said second chamber but permits carbon dioxide gas formed from the sublimation of the solid carbon dioxide to pass through.

13. The novelty item according to claim 12 wherein said separation means is hingedly connected to said interior surface.

14. The novelty item according to claim 12 therein said separation means is connected to said interior surface by a threaded portion.

* * * * *